United States Patent [19]

Buhrer

[11] 4,382,210

[45] May 3, 1983

[54] BALLAST CIRCUIT FOR DIRECT CURRENT ARC LAMP

[75] Inventor: Carl F. Buhrer, Framingham, Mass.

[73] Assignee: GTE Laboratories Incorporated, Waltham, Mass.

[21] Appl. No.: 332,065

[22] Filed: Dec. 18, 1981

[51] Int. Cl.[3] ..... H01J 7/44; H05B 37/00

[52] U.S. Cl. ..... 315/073; 315/49; 315/50; 315/223; 315/239

[58] Field of Search ..... 315/73, 74, 49, 50, 315/223, 239

[56] References Cited

U.S. PATENT DOCUMENTS

| | | | |
|---|---|---|---|
| 3,265,930 | 8/1966 | Powell . | |
| 3,969,652 | 7/1976 | Herzog . | |
| 4,121,136 | 10/1978 | Fournier et al. | 315/205 |
| 4,151,445 | 4/1979 | Davenport et al. | 315/92 |
| 4,170,744 | 10/1979 | Hansler | 315/90 |
| 4,170,746 | 10/1979 | Davenport | 315/246 |
| 4,189,663 | 2/1980 | Schmutzer | 315/205 |
| 4,208,603 | 7/1980 | Graves | 313/1 |
| 4,278,916 | 7/1981 | Regal et al. | 315/73 |

*Primary Examiner*—Harold A. Dixon

*Attorney, Agent, or Firm*—J. Stephen Yeo; Theodore D. Lindgren; Robert E. Walrath

[57] ABSTRACT

A high efficiency controlled direct current source for operating high pressure mercury or metal halide lamps for use as substitutes for ordinary incandescent lamps. The circuit includes a voltage sensitive circuit for pulsed starting of the arc discharge lamp as well as for the activation of an auxiliary incandescent filament during the warm-up or hot restart of the arc.

9 Claims, 3 Drawing Figures

BALLAST CIRCUIT FOR DIRECT CURRENT ARC LAMP

BACKGROUND OF THE INVENTION (1) Field of the Invention

This invention relates generally to an instant lighting lamp combining a miniature arc tube with a standby filament and is more particularly concerned with a ballasting arrangement to permit such a lamp to be used as a replacement for a conventional incandescent lamp.

(2) Description of the Prior Art

Electric arc lamps, such as the high pressure mercury vapor lamp or the metal iodide arc lamp related to it, are far more efficient light sources than the commonly used incandescent filament lamp. They have long been used for street lighting and in industrial applications. They have not been used at all in the home where most fixtures and lamps are designed to accommodate screw-in type incandescent lamps. Adapting these arc lamps, particularly in their smaller sizes, as direct replacements for incandescent lamps has become a serious energy saving goal.

The obstacle to be overcome in replacing the screw-in incandescent lamp with a small arc lamp is the ballasting circuit required to regulate the arc current being drawn from the fixed voltage AC power line. This circuit must be small and lightweight so that it can be integral to the light source package, and moreover, it must be simple and inexpensive so that the replacement lamp is affordable to the consumer. Most important, it should be energy-efficient so that the high efficiency of the arc lamp is not degraded by losses in the ballasting circuit.

As a replacement for an incandescent lamp in the home, two other pecularities of the arc lamp must be overcome to make the new device an acceptable light source. One is the slow arc warm-up during which time the light intensity only gradually increases, the other is the inability to hot restart, which means that a momentary shut-off of the arc by a power line interruption requires the lamp to first cool down, restart and then warm up again, during which time it does not produce much light. To remedy this unacceptable behavior, an auxiliary incandescent filament is included within the same glass jacket that encloses the small quartz arc tube. It produces light immediately upon turn-on while the arc lamp is warming up, and also comes on during any hot restart cycle so that there is always some light output produced.

Prior art ballast circuits have been designed to power a small direct current metal halide lamp. This lamp nominally contains a fill consisting of mercury, iodides of sodium and scandium, and argon gas. It requires a starting potential of several hundreds of volts to initiate ionization, several seconds of operation at about 200 V and a few tens of milliamperes to transfer from a glow to an arc discharge and full current for about a mninute warm-up during which time its potential drop rises from about 20 to 80 V. Such DC arc lamps are most simply operated in series with the auxiliary incandescent filament from a DC source obtained by rectifying and filtering the AC power line. In this way, the filament serves as a ballast and produces light during the arc warm-up. Separate circuitry must be used to turn on the filament during cool-down in a hot restart cycle. With this simple circuit, the voltage across the filament is equal to the difference between the rectifier output and the arc lamp voltage, and this difference decreases as the arc lamp warms up. After warm-up, little light is produced by the auxiliary filament, but current continues to flow through it, and its power dissipation is a significant source of inefficiency in this circuit.

OBJECTS AND SUMMARY OF THE INVENTION

It is an object of this invention to provide an energy-efficient means for ballasting the arc lamp after warm-up, such that during normal operation the high luminous efficiency of the arc can be exploited. It is a further object of this invention to provide control means for starting the arc lamp by electronic voltage pulsing and for operating the auxiliary incandescent filament only during the warm-up and the hot restart cycles when the additional light output is desirable. It is a still further object of this invention to make multiple uses of several of the circuit components to achieve all of the above operative features with the fewest components and at the lowest feasible cost.

In one aspect of this invention the above and other objects and advantages are achieved in a combination discharge and incandescent lamp assembly. The assembly includes a miniature arc discharge lamp, an incandescable filament, and a thermal switch having break and make contacts mounted within a sealed outer envelope. A control circuit in the assembly is arranged to operate from an alternating current source. The control circuit includes rectification means, first and second series circuits, a controlled rectifier, and a gate control circuit. The rectification means converts an input alternating current to a direct current. The first series circuit is connected across the output terminals of the rectification means and includes the incandescable filament, the break contacts of the thermal switch, a first inductor, and the discharge lamp. The break contacts are closed until the discharge lamp reaches a predetermined operating temperature. The controlled rectifier is connected in series with the make contacts of the thermal switch. The make contacts are closed when the discharge lamp reaches the predetermined operating temperature. The second series circuit is connected in parallel with the controlled rectifier and includes a capacitor and a second inductor magnetically coupled to the first inductor. The gate control circuit is connected in parallel with the discharge lamp and to a gate of the controlled rectifier. The gate control circuit causes the controlled rectifier to periodically conduct upon energization of the control circuit to cause pulses to be coupled from the second inductor across the first inductor to boost the voltage across the discharge lamp, causes the controlled rectifier to cease conducting upon initiation of an arc mode in the discharge lamp, and causes the controlled rectifier to conduct to cause current flow through the incandescable filament when discharge in the discharge lamp is extinguished and the make contacts are closed.

DESCRIPTION OF THE PREFERRED EMBODIMENT

Figure 1:
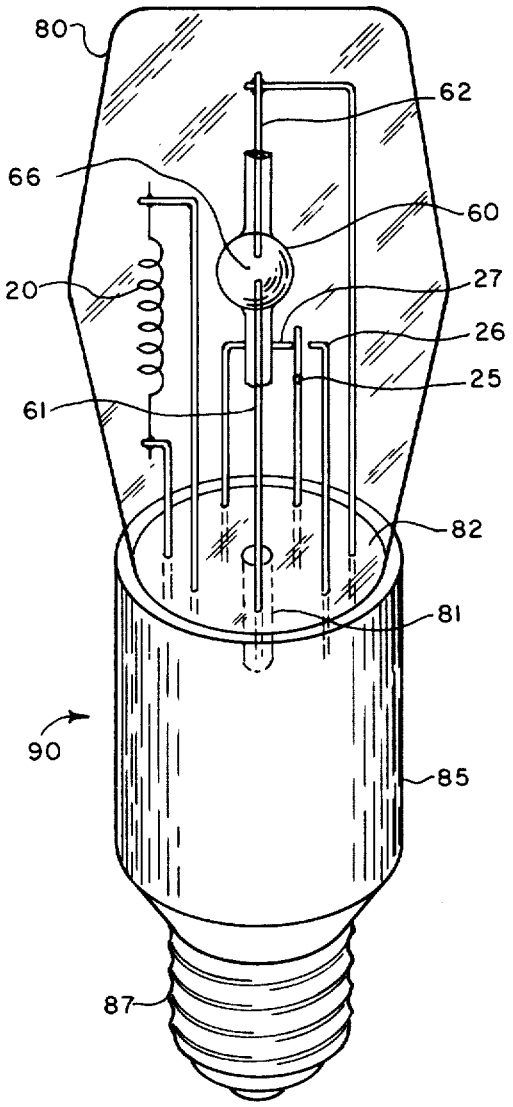
FIG. 1 of the drawings shows in side elevation a combination discharge-incandescent lamp embodying a part of the invention.

FIG. 1 shows the composite light source assemby 90, including a glass envelope 80 containing a quartz arc tube 60, having a top cathode electrode 62, a lower anode electrode 61 and fill materials 66. Also within the envelope 80 is an auxiliary incandescent filament 20 and a thermally activated single pole double throw snap action switch 25. The switch 25 is positioned in thermal contact with the quartz arc tube 60 such that contact 27, which is closed when the arc tube is cool, opens and contact 26 closes when the arc tube reaches operating temperature. The armature of switch 25 is constructed to have mechanical hysteresis and, therefore, a snap action in moving from one position to the other. The reverse switching action of opening from contact 26 and closing to contact 27 is adjusted to take place when the arc tube has cooled to a temperature at which it can be restarted. Leads for all of the components are brought out through a pressed glass header 82 and the envelope 80 is evacuated through exhaust tube 81.

Below the glass envelope 80 of the light source assembly 90 is an enclosure 85 housing the electronic components, constituting the ballast circuit shown in FIG. 2. A screw base 87 allows the assembly 90 to replace directly a screw-in incandescent lamp.

Figure 2:
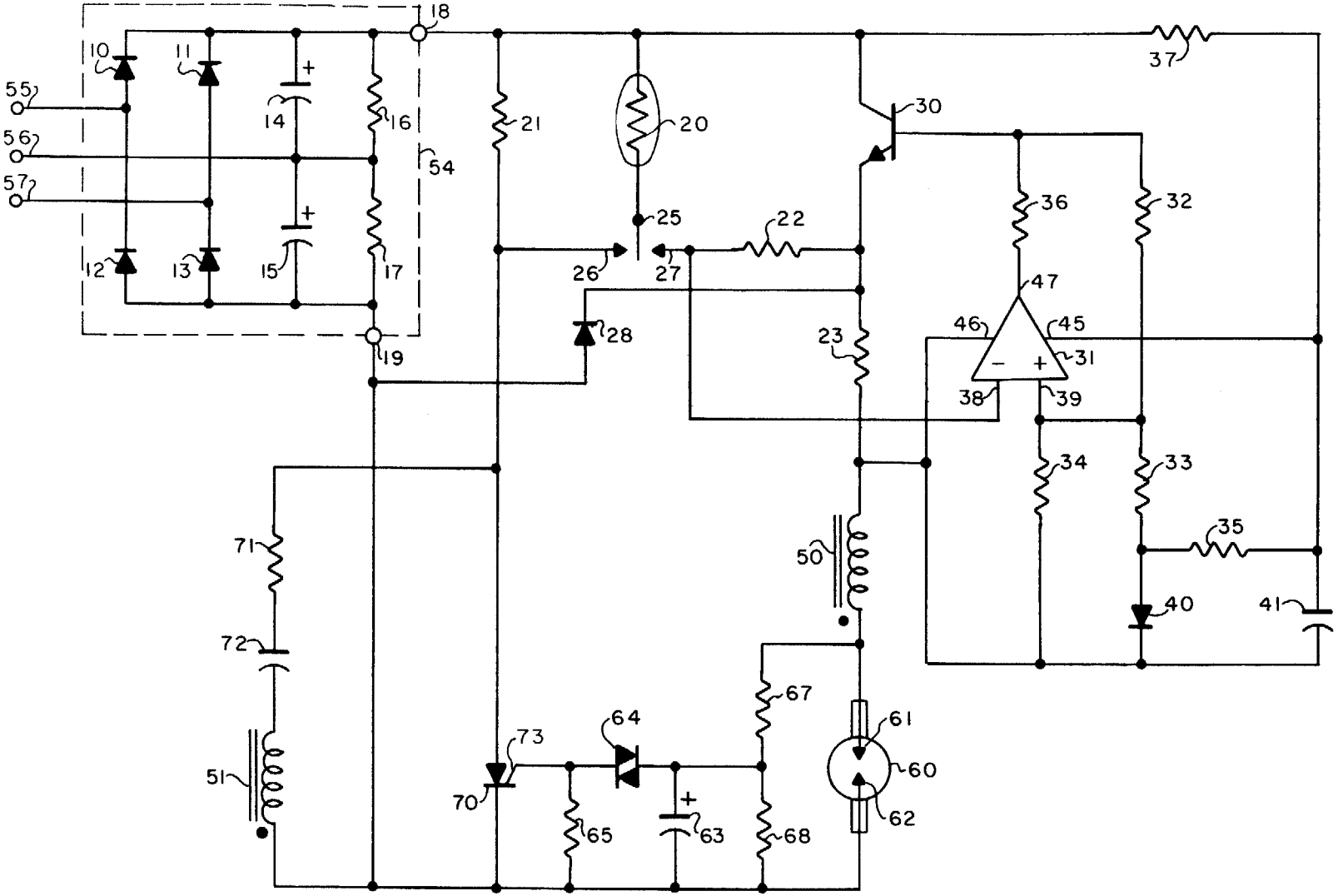
FIG. 2 is a circuit diagram of one embodiment of the invention.

The electronic ballast circuit of the present invention is shown in FIG. 2. Silicon rectifier diodes 10, 11, 12, and 13 are connected in a bridge circuit 54, with the rectified output filtered by electrolytic type capacitors 14 and 15. When a 220 V AC power line is connected across terminals 55 and 57, a rectified and filtered DC voltage is produced between points 18 and 19. Alternatively, a 110 V AC power line may be connected between terminal 56 and either terminal 55 or 57. In this case, the circuit acts as a full wave voltage doubler. In either case about +300 V is produced at point 18 relative to point 19. Bleeder resistors 16 and 17 serve to equalize the capacitor voltages and to drain their charge when the input power is turned off.

When power is first applied to this circuit, current flows from the rectifier output point 18 through auxiliary filament 20, closed switch contacts 25 and 27 of thermal switch 25, current sensing resistors 22 and 23 and inductor 50 to arc discharge tube 60 which blocks any further current flow because it is not yet conductive. The 300 V rectifier output appears across resistive dividers 67 and 68, and also charges capacitor 72 via resistors 21 and 71 and inductive winding 51 which shares a common magnetic core with inductor 50. Capacitor 63 charges via resistor 67 and when its voltage reaches the breakdown potential of trigger diac 64, it discharges into the gate of a controlled rectifier or thyristor 70, causing it to conduct a pulse of current as it discharges capacitor 72 through resistor 71 and inductive winding 51. The mutual inductance between windings 50 and 51 and the turns ratio of the transformer that they comprise results in a positive high voltage pulse being applied to the anode electrode 61 of arc tube 60. Resistor 71 dampens excessive ringing of the circuit. Capacitors 72 and 63 recharge, and this triggering pulse action is repeated until arc tube 60 ionizes and continues to conduct in the arc mode. Then the voltage drop across the resistive divider 67, 68 is too low to allow further conduction of diac 64, and triggering of thyristor 70 ceases.

As the arc lamp warms up, current through auxiliary incandescent filament 20 produces light of a slowly decreasing intensity, but the combined voltage drops across resistors 22 and 23 remain sufficient to ensure that voltage comparator 31 keeps NPN darlington transistor 30 in the nonconducting state. During the warm-up cycle, operation is essentially that of a series connected incandescent filament arc lamp combination described above. Power is dissipated in the filament 20, but the desired supplemental light is being produced while the arc lamp is approaching its full output. When warm-up is complete, thermal switch 25 opens from contact 27 and closes to contact 26.

Current in resistor 22 is interrupted, but that in resistor 23 continues while decreasing in magnitude—it being driven through diode 28 and arc lamp 60 by the voltage induced across inductor 50 by the decreasing current. The voltage drop across current sensing resistor 23 is applied to the inverting input 38 of voltage comparator 31 via resistor 22. When the current in resistor 23 falls below a level $I_{LOW}$ determined by the positive bias voltage on the noninverting input 39, base current is supplied to transistor 30 via resistor 36, turning it on to the conducting state. Also, because of the positive feedback resistor 32 around the comparator 31, the positive bias on input 39 is increased to a new higher value. Comparator power supply current continues to flow from storage capacitor 41 which is charged via resistor 37 when transistor 30 is not conducting. Resistor 35 and forward conducting diode 40 supply a constant voltage reference coupled to input 39 by resistor 33.

With transistor 30 saturated in the on state, current from the rectifier output point 18 increases rapidly, flowing through transistor 30, resistor 23, inductor 50 and arc lamp 60. The rate of increase depends on the inductance of inductor 50 and the voltage across it; this being essentially the difference between the rectifier output and the arc lamp voltage drop, because the voltages across the saturated transistor 30 and current sensing resistor 23 are small. When the current through resistor 23 rises above a level $I_{HIGH}$, determined by the new bias voltage on input 39, the comparator output switches the transistor 30 to the off state, and also because of the positive feedback through resistor 32, changes the bias on input 39 back to the original lower value. With transistor 30 off, the current again passes through diode 28, resistor 23, inductor 50, and lamp 60 as it decreases in value to the $I_{LOW}$ value. Thus, the current in arc lamp 60 oscillates between a minimum value $I_{LOW}$ and maximum value $I_{HIGH}$ as the control circuit flip-flop, consisting of comparator 31 and its biasing network resistors 32, 33, 34, 35, and 36, switches the darlington transistor 30 on and off again.

While this oscillating action is taking place at a frequency of several kilocycles, the arc lamp is operating normally in its high efficiency mode. Auxiliary incandescent filament is switched via contact 26 to thyristor 70, but is not conducting current because the thyristor has not been triggered since the contact 26 was closed.

This latter circuit is used to provide light during the cool-down part of the hot restart cycle. If the power input to the ballast is momentarily interrupted, arc lamp 60 will go out and not restart, because it is too hot. The voltage across divider resistors 67 and 68 rises above the normal operating lamp voltage and allows capacitor 63 to charge to diac 64 breakdown potential. Only one pulse to the gate 73 of thyristor 70 is enough to turn it on, thereby lighting the auxiliary incandescent filament 20 via the path from terminal 18, the filament 20, thermal switch 25 to contact 26 and back through the thyristor to terminal 19. This provides light while the arc discharge tube cools and only turns off when thermal switch 25 opens the circuit of contact 26. If thermal switch 25 is designed to snap quickly to close to contact 27, lamp 20 will be off only momentarily until the pulse starting circuit reignites the arc tube 60 and the warm-up cycle begins. As the arc lamp 60 approaches its operating temperature, its light output increases and the light from the auxiliary incandescent filament 20 decreases until thermal switch 25 switches the circuit into the high efficiency electronic switching mode of operation with auxiliary incandescent filament 20 turned off. The miniature arc lamp is one designed for operation on direct current with a power input to the lamp of 30 to 40 W. Its operating voltage is about 80 V.

In the present invention, the transformer, consisting of inductors 50 and 51, serves the dual function of providing the high voltage starting pulses to the lamp and operates as an energy storage device during the normal operation of the lamp in the switching mode at high efficiency. The control circuit, consisting of thyristor 70, diac 64, capacitor 63 and resistors 65, 67 and 68, serves the dual functions of pulsing the inductor 51 during the starting of arc lamp 60 and of switching on auxiliary incandescent filament 20 during the cool-down part of the hot restart cycle. The high voltage darlington transistor 30, current sensing resistors 22 and 23, and the comparator circuit 31, with its associated components, are the principal components needed to achieve the high energy efficiency of this ballast circuit.

The switching action taking place in the normal mode of operation is energy efficient, because the power losses in the components involved are only due to the nonideal nature of their operation. For example, small forward voltage drops exist during the conduction intervals in darlington transistor 30 and diode 28, and these constitute power dissipation. In addition, the winding resistance of inductor 50 contributes to the loss, as do eddy currents in its core. All these add to only a few watts while about 30 to 40 watts of power are being fed to the arc lamp 60. In contrast, if the arc lamp 60 were to be resistively ballasted by the auxiliary incandescent filament 20 not only during its warm-up but also continuously during its normal operation, there would exist across the auxiliary incandescent filament 20, a voltage drop equal to the difference between the voltage output of rectifier bridge 54 and the voltage drop of arc lamp 60. Thus, the auxiliary incandescent filament 20 could dissipate nearly as much power as the arc lamp 60, giving an efficiency of little more than fifty percent (50%).

Figure 3:
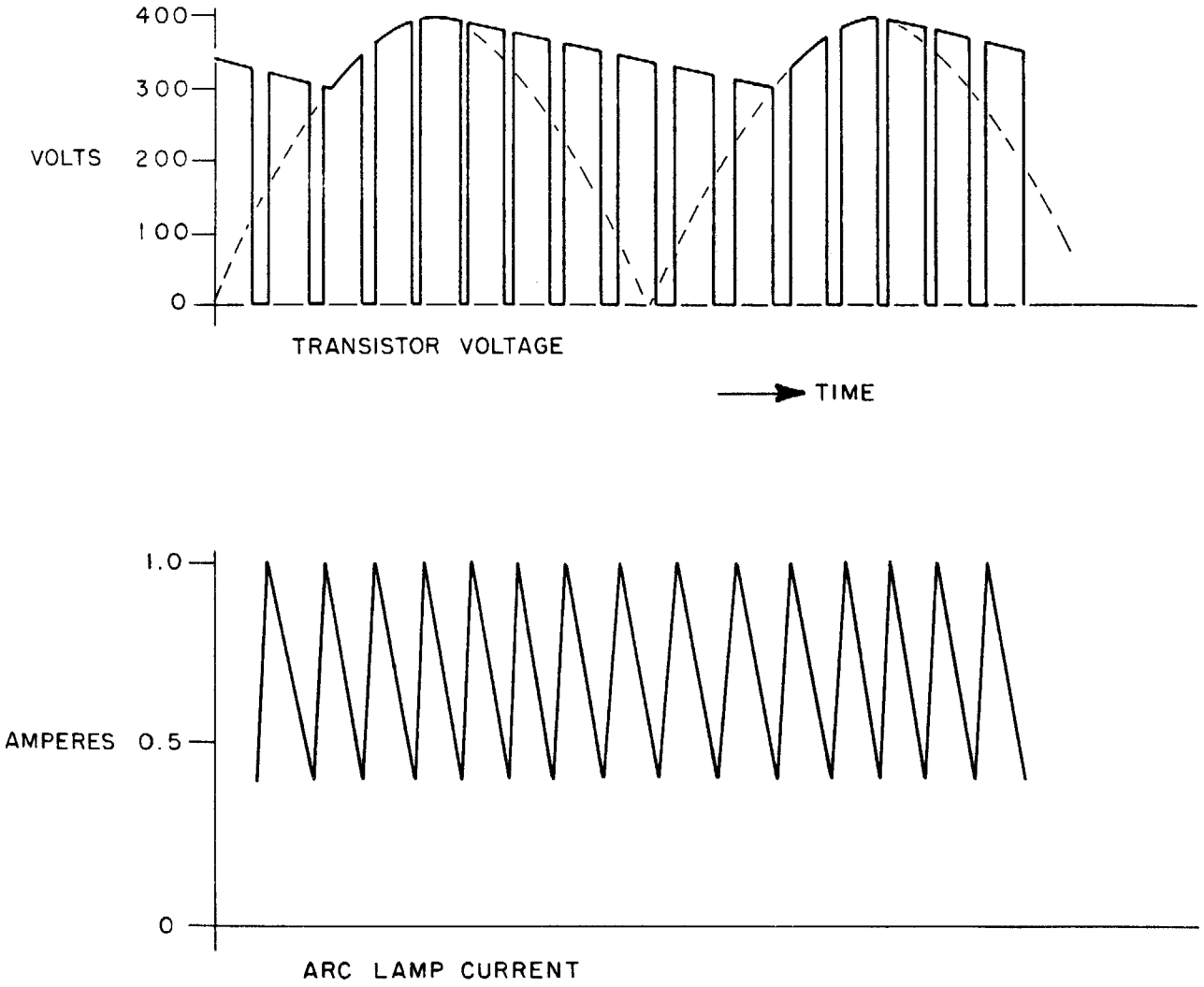
FIG. 3 is a graph illustrating the arc lamp current and the control transistor voltage.

The upper part of FIG. 3 shows the variations with time of the voltage across darlington transistor 30. It switches between the rectifier output voltage when it is not conducting to essentially zero when it switches on. The rectifier output reaches a peak value essentially equal to the peak power line input voltage shown by the dotted lines in the Figure, but drops downward as the filter capacitors 14 and 15 discharge between half-cycle peaks of the line input voltage. The transistor 30 switching frequency is modulated by the rectifier output ripple voltage, it being greatest at the line peaks. The actual frequency of oscillation is 3 to 5 kHz, or several times that shown in the diagram.

The lower part of FIG. 3 shows the variation with time of the current through arc lamp 60, inductor 50 and sensing resistor 23. The limits $I_{MAX}$ and $I_{MIN}$ are determined by the circuit parameters around comparator 31, while the rate of change of the current is determined by the voltage across the inductor 50 divided by its inductance. During discharge of the energy in the inductor, its current decrease and its voltage is essentially equal to the arc lamp voltage drop. The current increases when the darlington transistor 30 is conducting. Then the voltage across the inductor reverses polarity and is essentially equal to the difference between the voltage output of the rectifier and filter assembly 54 and the voltage drop across the arc lamp. The current sensing resistors 22 and 23 are a fraction of an ohm and dissipate essentially no power.

The voltage comparator 31 is a commercial type LM358 operational amplifier integrated circuit powered by terminals 45 and 46 with a DC voltage stored in capacitor 41. The output terminal 47 of comparator 31 supplies base current to darlington transistor 30 via resistor 36 when input 38 is negative compared to input 39. The current limits sensed by the comparator 31 are given by the equations:

$$I_{MAX} = \frac{V_{BASE}R_{34}R_{33} + V_{DIODE}R_{34}R_{32}}{R_{23}(R_{32}R_{33} + R_{34}R_{32})}$$

$$I_{MIN} = \frac{V_{DIODE}R_{34}R_{32}}{R_{23}(R_{32}R_{33} + R_{34}R_{33} + R_{34}R_{32})}$$

where $V_{BASE}$ is the forward base to emitter voltage of darlington transistor 30, $V_{DIODE}$ is the forward voltage of reference diode 40 and $R_{23}$, $R_{32}$, $R_{33}$ and $R_{34}$ are the resistances of the corresponding resistors.

Resistive divider 67, 68 is designed to charge capacitor 63 to the 32 volt breakdown voltage of diac 64 when the arc lamp voltage reaches about 180 V. This is the case during starting, but is well above the operating voltage of the arc lamp during normal operation, during which time the thyristor gate is kept at the cathode potential by resistor 65.

Inductors 50 and 51 are wound on a 0.25 inch high stack of E-I shaped grain-oriented silicon iron laminations 0.006 inches thick. Inductor 51 is wound first on a plastic bobbin as 35 turns of #26 enameled wire and after a layer of insulation, 420 additional turns of #26 wire are wound to form inductor 50. The 0.375 inch wide center leg E-I core is inserted and assembled with a 0.010 inch magnetic gap to give an inductance value of approximately 30 millihenries for inductor 50. Using this inductor, the switching frequency was in the 3 to 5 kHz range.

Thus, what has been described is a high efficiency controlled direct current source for high pressure mercury or metalarc lamps. It provides for pulsed starting of the arc discharge lamp as well as the activation of an auxiliary incandescent filament during the warm-up or hot restart of the arc. By the use of a minimal number of components, several of which serve multiple functions, the cost of the ballast is kept very low.

What is claimed is:

1. A combination discharge, incandescent lamp assembly including a miniature arc discharge lamp, an incandescable filament, and a thermal switch having break and make contacts mounted within a sealed outer envelope, and a control circuit in a common assembly arranged to operate from an alternating current source, said control circuit comprising:

rectification means, having a pair of output terminals, for converting an input alternating current to a direct current across said output terminals;

a first series circuit connected across said direct current output terminals, said first series circuit including said incandescable filament, said break contacts of said thermal switch, a first inductor, and said discharge lamp, said break contacts being closed until said discharge lamp reaches a predetermined operating temperature;

a controlled rectifier connected in series with said make contacts of said thermal switch across said output terminals, said make contacts being closed when said discharge lamp reaches said predetermined operating temperature;

a second series circuit connected in parallel with said controlled rectifier, said second series circuit including a capacitor and a second inductor magnetically coupled to said first inductor said circuit receiving charge from said direct current output terminals;

a gate control circuit connected in parallel with said discharge lamp and responsive to lamp voltage and to a gate of said controlled rectifier for causing said controlled rectifier to periodically conduct upon energization of the control circuit to cause pulses to be coupled from said second inductor across said first inductor to boost the voltage across said discharge lamp for igniting the same and for causing said controlled rectifier to cease conducting upon initiation of an arc mode in said discharge lamp, and for causing said controlled rectifier to conduct to cause current flow through said incandescable filament when discharge in said discharge lamp is extinguished and said make contacts are closed.

2. A combination discharge, incandescent lamp assembly as claimed in claim 1 further including:

a switching means connected in shunt with said filament and said thermal switch of said first series circuit to control the current through said discharge lamp after said break contacts open; and current sensing means responsive to a predetermined first current level through said discharge lamp to control said switching means to a conductive state and responsive to a predetermined second level through said discharge lamp to control said switching means to a nonconductive state.

3. A combination discharge, incandescent lamp assembly as claimed in claim 2 wherein said current sensing means comprises a differential amplifier having a first and a second input and an output, said output connected to control said switching means, a constant voltage source, said first input connected to said constant voltage source and said second input connected to sense the voltage across a resistance means included in said first series circuit.

4. A combination discharge, incandescent lamp assembly as claimed in claim 3 wherein said switching means comprises a transistor having a connection from its base to the output of said differential amplifier.

5. A combination discharge, incandescent lamp assembly as claimed in claim 4 further including a current limiting resistor in said connection from the transistor base to the output of said differential amplifier.

6. A combination discharge, incandescent lamp assembly as claimed in claim 3 wherein said constant voltage source comprises a second capacitor shunted by a diode, the combination connected between an output terminal of said rectification means and the terminal of said first inductor remote from said discharge lamp.

7. A combination discharge, incandescent lamp assembly as claimed in claim 2 further including a diode connected from a terminal of said rectification means to said first series path between said thermal switch and said first inductor for maintaining a current flow in said discharge lamp and first inductor during the non-conductive interval of said switching means.

8. A combination discharge, incandescent lamp assembly as claimed in claim 1 wherein said thermal switch operates to open said make contacts to interrupt the filament and controlled rectifier operating path upon said discharge lamp cooling down to an ignitable temperature.

9. A combination discharge, incandescent lamp assembly as claimed in claim 8 wherein said reclosing of said break contacts operates to complete said first series circuit to operate said starting circuit to again pulse said discharge lamp for reignition.

* * * * *